US006865282B2

(12) United States Patent
Weisman

(10) Patent No.: US 6,865,282 B2
(45) Date of Patent: Mar. 8, 2005

(54) LOUDSPEAKER SUSPENSION FOR ACHIEVING VERY LONG EXCURSION

(76) Inventor: Richard L. Weisman, 1449 E. Mirador Dr., Pasadena, CA (US) 91103

( * ) Notice: Subject to any disclaimer, the term of this patent is extended or adjusted under 35 U.S.C. 154(b) by 152 days.

(21) Appl. No.: 10/428,515

(22) Filed: May 1, 2003

(65) Prior Publication Data

US 2004/0218778 A1 Nov. 4, 2004

(51) Int. Cl.[7] ..... H04R 25/00

(52) U.S. Cl. ..... 381/404; 381/398; 381/403; 381/412

(58) Field of Search ..... 381/396, 398, 381/403, 404, 405, 412, 414, 420, 423, 433; 181/171, 172

(56) References Cited

U.S. PATENT DOCUMENTS

| | | | | | |
|---|---|---|---|---|---|
| 1,957,562 | A | * | 5/1934 | Tolerton | 381/404 |
| 5,081,684 | A | * | 1/1992 | House | 381/420 |
| 5,883,967 | A | * | 3/1999 | House | 381/398 |
| 2003/0190051 | A1 | * | 10/2003 | Williamson | 381/398 |

* cited by examiner

*Primary Examiner*—Huyen D. Le
(74) *Attorney, Agent, or Firm*—Richard Calderwood

(57) ABSTRACT

An electromagnetic transducer such as an audio speaker employs a slotted yoke and two suspension components enabling very large excursion relative to the size of the diaphragm which results in improved low frequency output. A first suspension component includes an inner ring, flexible springs, and an outer body. The flexible springs extend through the slots of the yoke and couple the inner ring to the outer body. The inner ring, outer body, and flexible springs of the first suspension component may be of monolithic construction or they may be distinct components coupled together. The inner ring couples to the bobbin of the diaphragm assembly, and the outer body couples to the outer cylindrical surface of the yoke or to a mounting ring which is coupled to the outer cylindrical surface of the yoke. A second suspension component, such as a surround, couples the diaphragm assembly and to the mounting ring. The mounting ring and the outer body of the first suspension component are keyed and dimensioned to provide correct positioning and alignment of the inner ring. This accomplishes accurate positioning of the voice coil in both the radial and axial directions without complicated and expensive assembly equipment.

33 Claims, 10 Drawing Sheets

FIG. 1 - prior art

FIG. 2 - prior art

LOUDSPEAKER SUSPENSION FOR ACHIEVING VERY LONG EXCURSION

BACKGROUND OF THE INVENTION

1. Technical Field of the Invention

This invention relates generally to electromagnetic transducers such as audio speakers, and more specifically to suspension components such as spiders, and to means for centering the voice coil axially and radially.

2. Background Art

FIG. 1 illustrates a conventional speaker 10 with an external magnet geometry motor structure 12 driving its diaphragm assembly 14. The motor structure includes a soft magnetic T-yoke 16 or pole which includes a back plate 18 and a pole piece 20 that are either magnetically coupled or of integral construction. The T-yoke may optionally include a ventilation hole 22 for depressurizing the diaphragm assembly. One or more external ring permanent magnets 24 are magnetically coupled to the back plate. A soft magnetic top plate 26 is magnetically coupled to the permanent magnets. A magnetic air gap 28 is formed between the top plate and the pole piece.

The diaphragm assembly includes a flexible suspension component 34 known as a surround, a diaphragm 32 or cone serving as the principal acoustic element, a voice coil former or bobbin 36 coupled to an electrically conductive voice coil 40, a spider 38 which acts as a second suspension component, and a dust dome 42 attached to the diaphragm to seal the open end of the bobbin and serving as a secondary acoustic element. A frame or basket 30 is mechanically attached to the motor assembly and supports the suspension components of the diaphragm assembly. The surround and spider allow the bobbin and diaphragm to move axially with respect to the motor structure but prevent, as much as possible, their lateral or radial movement. The voice coil is wound around and mechanically coupled to the bobbin, and is disposed within the magnetic air gap of the motor structure. The spider and the surround must keep the voice coil and the bobbin from rubbing against any part of the stationary motor structure.

FIG. 2 illustrates a conventional speaker 50 with an internal magnet geometry motor structure 52 driving the diaphragm assembly 14. The motor structure includes a soft magnetic yoke 54 or cup. One or more internal permanent magnets 56 are magnetically coupled to the yoke, and an internal soft magnetic top plate 58 is magnetically coupled to the permanent magnets, forming a magnetic air gap 60 between the top plate and the yoke. The motor structure may be ventilated, as shown, or it may be unventilated and have disc magnets and a disc plate, rather than the ring configuration shown.

To achieve the long axial excursions required to produce low frequencies, it is desirable that the suspension components provide as much radial centering force as possible, but as little axial force as possible. It is also desirable that the suspension components have as little mass as possible, and as little unit-to-unit variability as possible, so a production run of speakers will have predictable, constant characteristics of resonant frequency, frequency response, efficiency, and so forth.

FIG. 3 illustrates a conventional spider 38. One aspect of a conventional spider whose unit-to-unit process variability is undesirably high, is the glue which is used to couple the inner diameter 62 of the spider to the bobbin (not shown). It is difficult to control the precise amount of glue applied to each unit, which results in slightly different moving mass from speaker to speaker. Furthermore, when the glue is applied to the flexible spider, the glue tends to spread outward from the bobbin, wicking into the material of the spider to an outer glue perimeter 64. The glued portion will typically be stiffer than the rest of the spider, increasing the spider's overall stiffness. Unit-to-unit variance in the distance that the glue wicks will result in higher speaker-to-speaker performance variability.

FIG. 4 illustrates a further complication that results from gluing the spider 38 to the bobbin (not shown). If the glue wicks to a perimeter 66 which is asymmetric in shape or which is asymmetrical about the axis of the bobbin, the suspension will be asymmetrical. Mass and stiffness asymmetries will tend to induce rocking of the moving parts, causing collisions against the non-moving parts. Such collisions not only produce unpleasant noise, but also reduce the performance of the speaker and may even damage it.

Yet another disadvantage is present in the prior art. During the assembly process, labor-intensive, time-consuming, and expensive steps and equipment are used in order to ensure that the moving parts are radially and axially centered about the non-moving parts of the motor structure. Complex assembly fixtures must be employed in expensive, automated assembly lines to meet minimum process repeatability requirements.

Another disadvantage of the prior art is the relatively low excursion enabled in typical small speakers, with their resulting low sound pressure levels and poor low frequency performance. One notable improvement in small speakers is illustrated in PCT patent application PCT/US99/15962 published as WO 00/05925 "Miniature Full Range Loudspeaker" by inventor Clayton Williamson. Williamson's speaker uses a conventional motor and a conventional diaphragm assembly, but attaches the surround to the bobbin ("voice coil form") rather than to the diaphragm and at a point somewhat lower than the outer end of the bobbin. Although the application is somewhat silent on this particular topic, having the surround attached at this more centralized point should tend to reduce rocking a little, although, because of its use of only a single suspension component, significantly less than the rocking reduction achieved by the present invention.

U.S. Pat. No. 5,081,684 "Shallow Loudspeaker with Slotted Magnet Structure" by William N. House teaches a speaker motor structure having a slotted yoke. The diaphragm is external to the radial dimensions of the yoke, and is rigidly coupled to the bobbin by ribs which extend through the slots. The sole purpose of the slotted motor structure is to allow a shallower overall speaker by allowing the rigid attachment ribs to pass within the motor structure, such that the diaphragm may be substantially coplanar with the motor structure rather than being positioned out in front of the motor structure as is conventionally the case.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

The invention may be utilized in a variety of magnetic transducer applications, including but not limited to audio speakers, microphones, mechanical position sensors, actuators, and the like. For the sake of convenience, the invention will be described with reference to audio speaker embodiments, but this should be considered illustrative and not limiting. The invention may prove especially useful in applications in which the ratio of diaphragm travel to diaphragm diameter is especially high, but, again, this should not be considered limiting.

Figure 1:
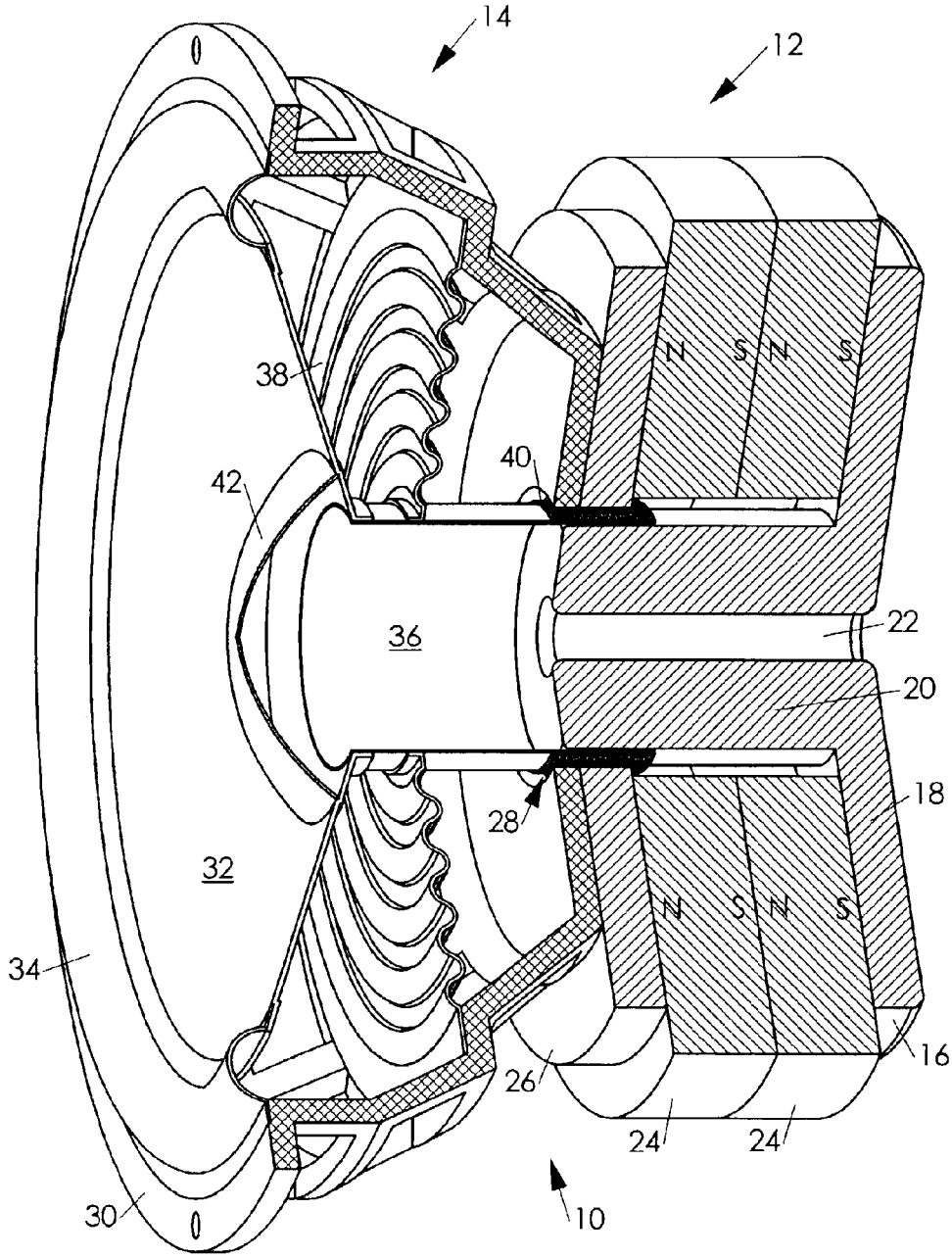
FIG. 1 shows, in cross-section, a conventional external magnet geometry speaker according to the prior art.
Figure 2:
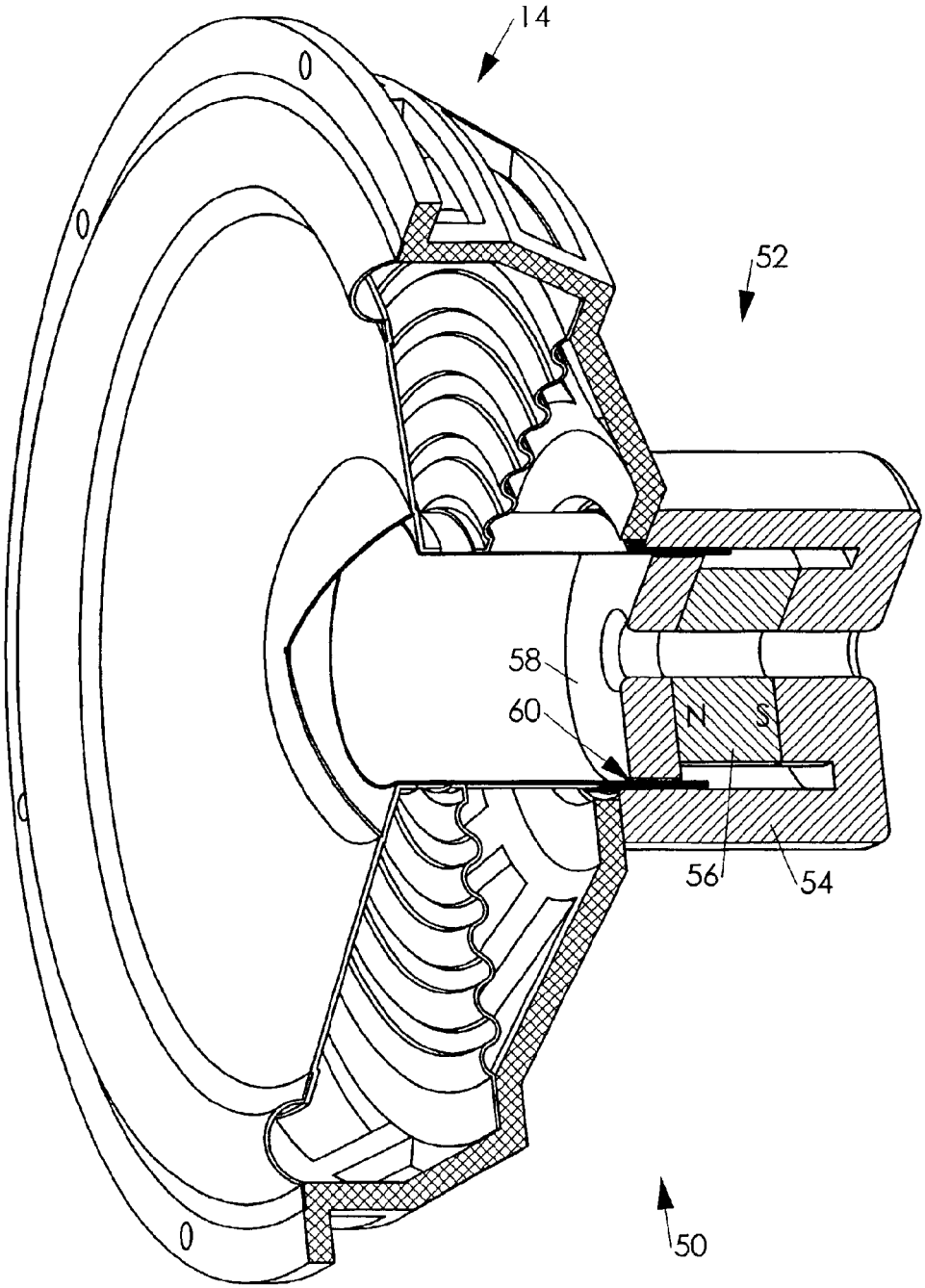
FIG. 2 shows, in cross-section, a conventional internal magnet geometry speaker according to the prior art.
Figure 3:
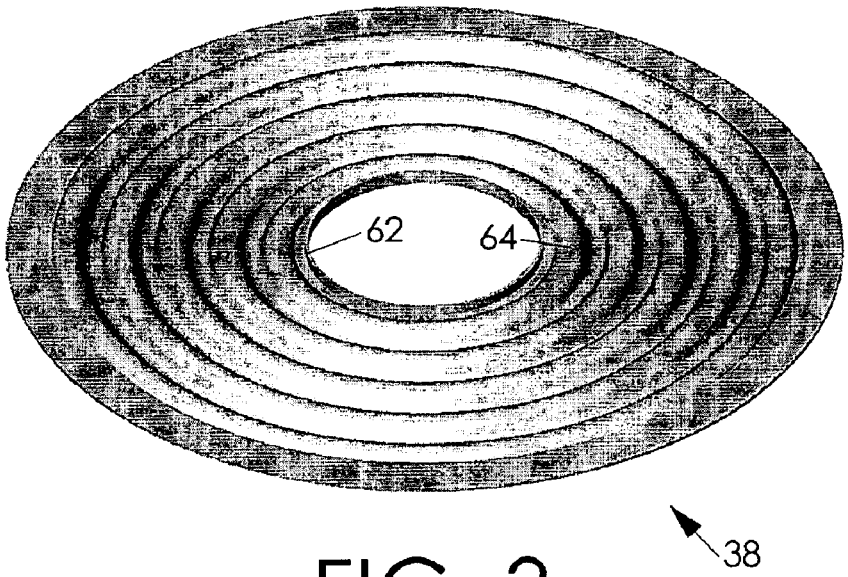
FIGS. 3 and 4 show a conventional spider having a glue fillet extending outward from the bobbin attachment.
Figure 4:
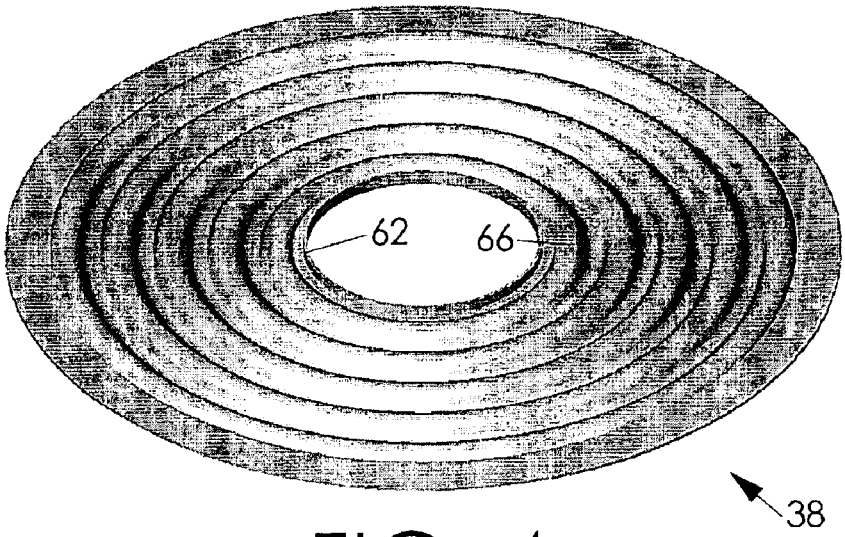
Figure 5:
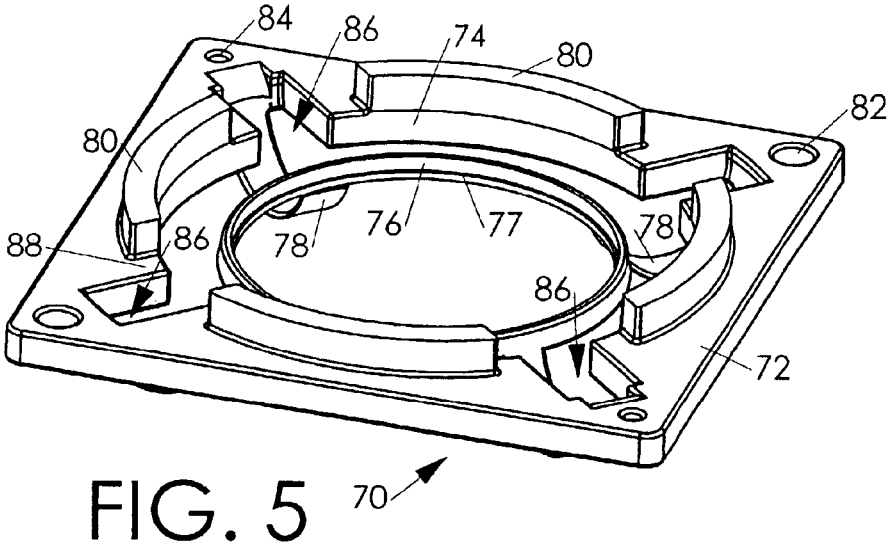
FIGS. 5 and 6 show top and bottom perspective views, respectively, of one embodiment of a self-centering spring spider according to this invention.
Figure 6:
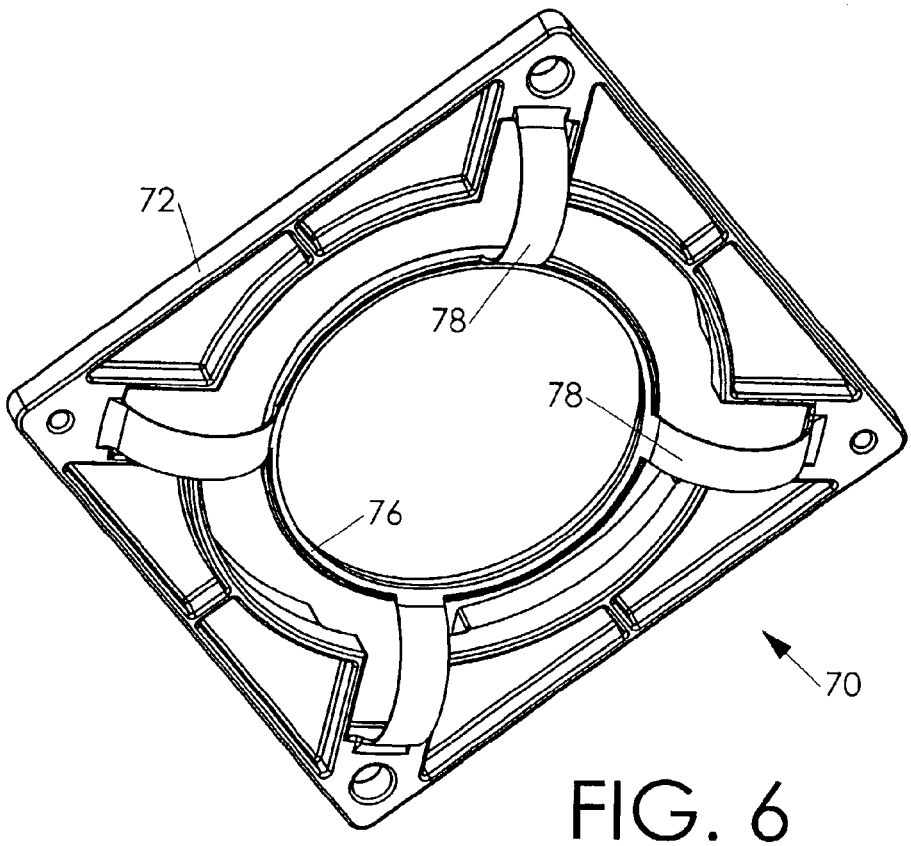

FIGS. 5 and 6 illustrate one embodiment of a self-centering spring spider 70 according to this invention. The spring spider includes an outer body 72 which includes an internal face 74 which may be dimensioned to mate with an external dimension of some component of a motor structure (not shown). The spring spider includes an inner ring 76 which is dimensioned to mate with a bobbin (not shown). The inner ring may include a lip 77 for engaging an end of the bobbin. The inner ring is coupled to the outer body by two or more (and, ideally, three or more) flexible spring members 78.

The flexible spring members provide good radial force to keep the inner ring radially centered, but have low axial force, enabling relatively free axial movement of the inner ring. In one embodiment, the flexible spring members, inner ring, and outer body are of monolithic construction. In one embodiment, they are injection molded as one unitary piece of plastic, such as Nylon 6/6. In other embodiments, the inner ring and/or the outer body may be distinct components coupled to the flexible spring members. In various embodiments, certain ones of the components may be made of plastic or of metal, respectively. For example, the outer body may be Nylon, the flexible spring members may be a metal such as spring steel, a shape memory alloy, a beryllium-copper alloy (which may also be used as the electrical conduction lead), or other suitable metal, and the inner ring may be Nylon or other suitable plastic. As another example, the inner ring and the flexible spring members may together comprise a monolithic injection molded Nylon part which is coupled to an aluminum outer body.

The skilled engineer will be able, armed with the teachings of this disclosure, to select dimensions and materials for the various components according to the specific demands of the application at hand.

In some embodiments, axial trueness and overall stiffness of the mounting of the spring spider to the motor structure may be enhanced by the addition of axially protruding members 80 at the mating surface 74. The spring spider may be adapted with mounting holes 82 for coupling the spring spider to other components of the speaker and/or to the baffle or cabinet into which the speaker is mounted. The spring spider may also be adapted with holes 84 at which the speaker's terminals or leads (not shown) may be mounted.

The length and the unimpeded travel of the flexible spring members 78 may be increased by providing cutaways 86 through the outer body, with the flexible spring members' outer ends being at the outer extents of these cutaways.

The outer body may be provided with one or more mating surfaces 88 which help determine the axial positioning of various components in a manner described below.

Figure 7:
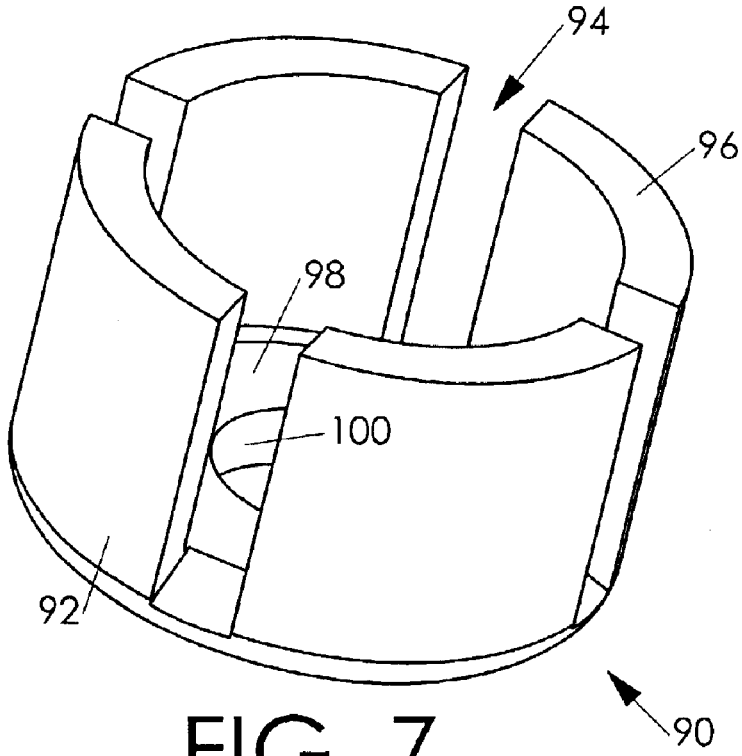
FIG. 7 shows a top perspective view of one embodiment of a slotted yoke such as may be used in conjunction with this invention.

FIG. 7 illustrates one embodiment of a slotted yoke 90 which may be utilized in conjunction with the spring spider of this invention. The slotted yoke includes a side wall portion 92 which may typically have a substantially cylindrical shape. The side wall portion includes slots 94 which have sufficient dimensions to permit the spring spider's flexible spring members to pass through and to move axially during operation of the speaker. In some embodiments, the slots extend from the upper surface 96 of the side wall portion axially downward toward or until the back plate portion 98 of the yoke. In other embodiments, the slots need not extend all the way up through the side wall portion, and may thus be holes rather than slots; in such embodiments, the spring spider will not be a monolithic structure, as its flexible spring members will need to be passed through the yoke's holes before complete assembly of the spring spider. The back plate portion of the yoke may include a hole 100 which aids in radial centering of the yoke during assembly of the speaker.

Figure 8:
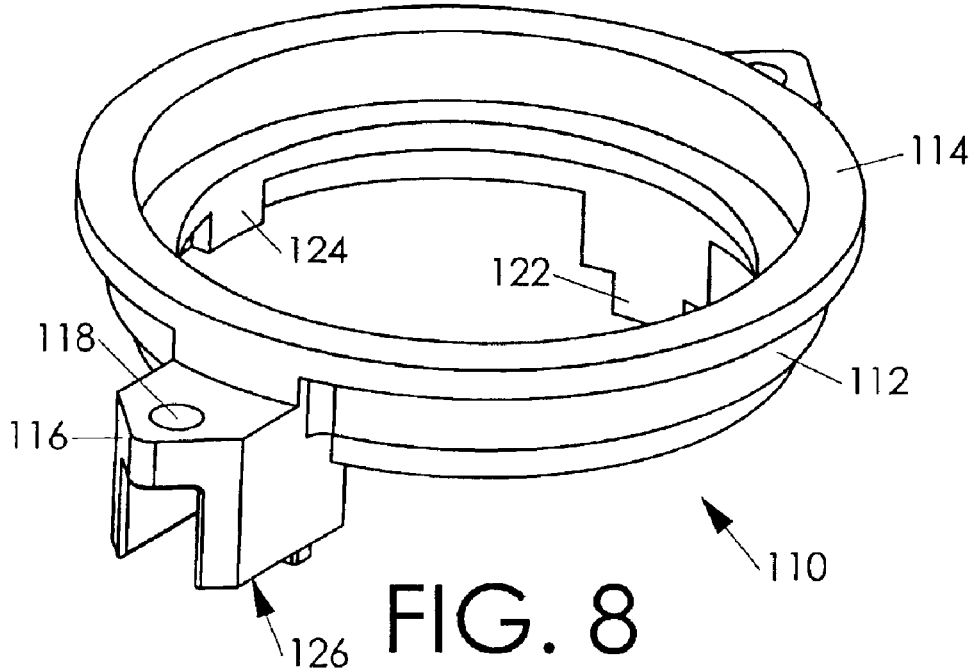
FIGS. 8 and 9 show a top perspective view, and one with a cutaway, of one embodiment of a surround mounting ring for use with the spring spider of this invention.
Figure 9:
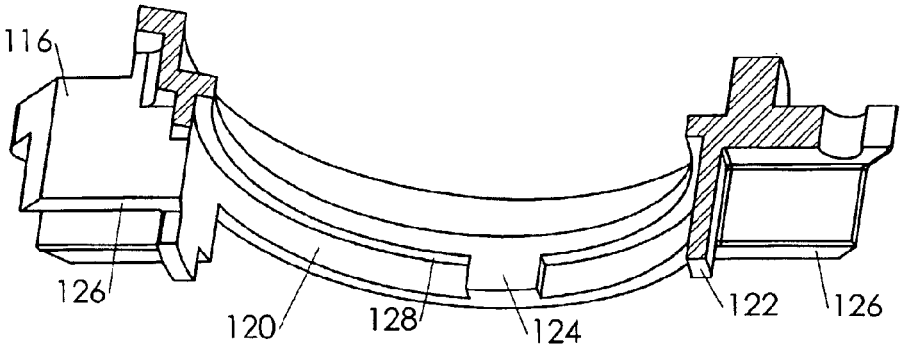

FIGS. 8 and 9 illustrate one embodiment of a mounting ring 110 which may be used in conjunction with the spider spring and the slotted yoke. The mounting ring serves as a form of frame for coupling and locating the motor structure (not shown) consisting of the yoke, magnet, and top plate, to the moving assembly (not shown) consisting of the diaphragm, surround, and voice coil assembly. The mounting ring includes a body 112 having a surround mounting surface 114. The body includes two or more support blocks 116 each including a mounting hole 118.

The mounting ring includes an inner surface 120 which may optionally be dimensioned to mate with an outer surface of the motor structure (not shown) to help aid in radial alignment. The support blocks may include tabs 122 which drop into and key with the cutaways 86 of the spring spider to radially align the mounting ring and the spring spider, and the body may include tabs 124 which drop into and key with the top of the yoke slots to key the mounting ring to the yoke. The bottom of the support blocks includes a mating surface 126 for coupling to the spring spider. The mounting ring includes a mating surface 128 for coupling to the upper surface (94) of the yoke to determine the axial position of the spring spider/mounting ring assembly with respect to the yoke.

Figure 10:
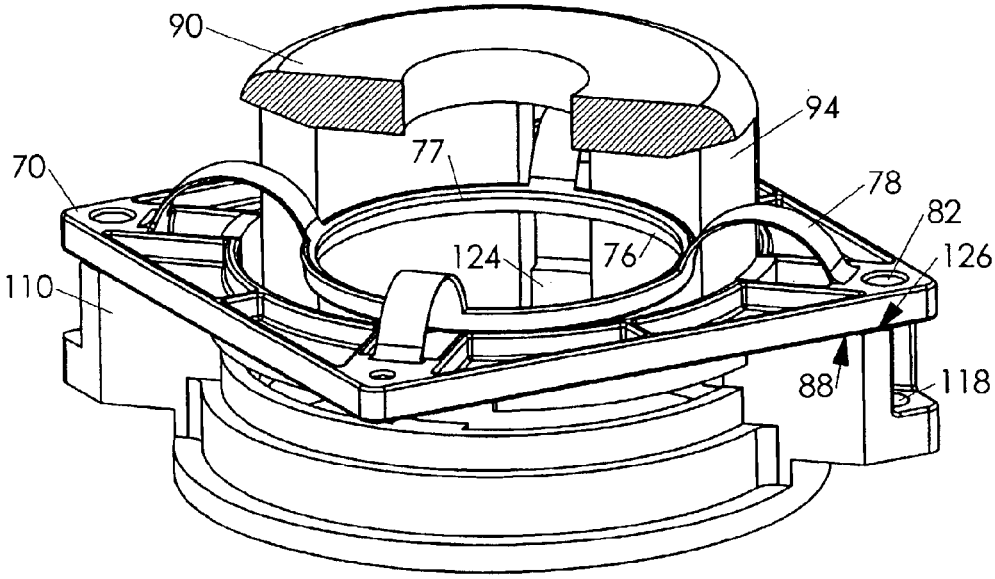
FIG. 10 shows a bottom perspective view of an assembly including the spring spider, the surround mounting ring, and the slotted yoke (which is shown in cutaway).

FIG. 10 illustrates an assembly 130 including the mounting ring 110 coupled to the spring spider 70 and to the yoke 90. The mounting holes 118 of the mounting ring are aligned with the mounting holes 82 of the spring spider, enabling a bolt or screw (not shown) to pass through both and couple the components together and/or to a baffle or enclosure. The yoke is shown half cut-away, for better visibility of the spring spider. The flexible spring members 78 of the spring spider pass through the slots 94 of the yoke, so the inner ring 76 inside the yoke is coupled in suspension to the outer body 72 of the spring spider outside the yoke. The mating surface 126 of the bottom of the support blocks 116 is snugly mated with the mating surface 88 of the outer body of the spring spider. Tabs 122 key into cutaways 86, and tabs 124 key into slots 94. This way, the springs members are centered with respect to the yoke slots 138.

Figure 11:
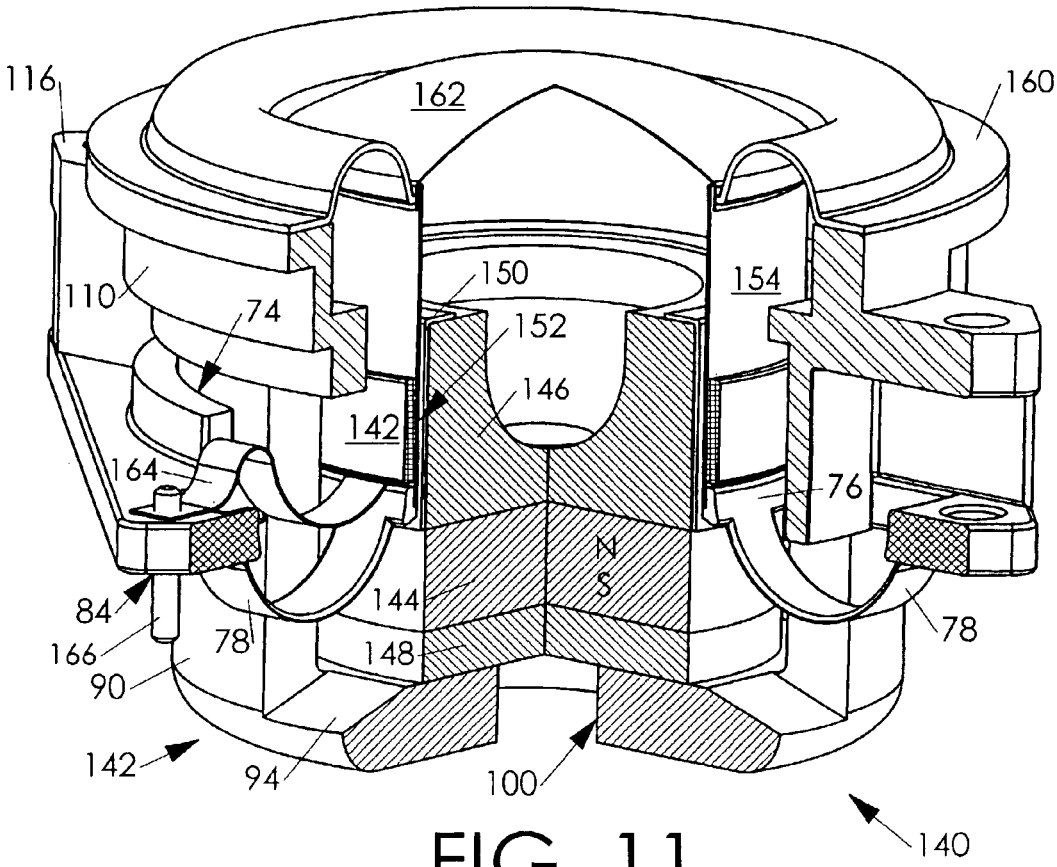
FIG. 11 shows a cutaway perspective view of an exemplary speaker constructed with the spring spider and surround mounting ring of this invention.

FIG. 11 illustrates one embodiment of a speaker 140 constructed according to the principles of this invention. The speaker includes an internal magnet geometry motor structure 142 including a soft magnetic yoke 90, a permanent magnet 144, and a soft magnetic top plate 146. Optionally, a soft magnetic spacer 148 may be magnetically coupled between the yoke and the magnet to raise the top plate and to prevent saturation of the yoke, especially in embodiments in which the yoke includes a hole 100 as illustrated. The hole may be advantageous in the stamping or other manufacturing of the yoke, and may be advantageous as a radial centering alignment means during assembly of the speaker. An electrically conductive cap 150 may be coupled to the top plate, and serves as a faraday loop to reduce flux modulation during operation of the speaker. The cap may be made of, for example, copper or aluminum. If the cap is omitted or does not extend into the magnetic air gap 152 between the top plate and the yoke, the magnetic air gap may be made narrower. In another embodiment, a disc or ring shaped faraday loop member (not shown) may be disposed between the magnet and the top plate, or between two separate, thinner top plate members. This may be in addition to, or in lieu of, the copper cap.

The mating surface 74 of the spring spider is coupled to the outside of the slotted yoke. The flexible spring members 78 extend through the slots 94, enabling the spring spider body 72 which is outside the yoke to be coupled to the inner ring 76 which is inside the yoke. As long as the soft magnetic material of the yoke between the slots is not in saturation, BL is not reduced by the presence of the slots; the effective circumferential length of the magnetic air gap is reduced by the width of the slots, but the magnetic flux density over the remainder of the circumference is increased proportionately.

The surround mounting ring 110 is coupled to the spring spider and to the top surface of the yoke. The bottom end of a bobbin 154 is coupled to the inner ring. A voice coil 156 is coupled to the bobbin. A diaphragm 162 is coupled to the bobbin. A surround 158 couples the diaphragm to the mounting ring. The active suspension portion of the surround is, in one embodiment, in the shape of a half roll. The surround also has a flat portion 160 which extends radially outward with enough space to as to also serve as a gasket for sealing the speaker to its mounting baffle.

The bobbin is supported both at its upper end and its lower end; in one embodiment, the support is at the extreme upper end and the extreme lower end. Maximizing the distance between the attachment of the spring spider and the surround provides the longest available moment arm, to reduce rocking of the moving assembly.

Flexible leads 164 are coupled to the respective ends of the voice coil wire and are brought out through the slots and mounted to terminal pins 166 which are coupled into the holes 84 through the spring spider. The leads may be constructed of any suitable material which is electrically conductive and flexible, such as copper, beryllium copper, or the like. The leads may be fashioned as strips as shown, or as woven or braided strands, or the like.

The inner ring of the spring spider may include a lip for engaging the end of the bobbin. The inner diameter of the inner ring is sized to fit over the bottom end of the bobbin, and the lip is sized to contact the bottom end of the bobbin and provide positive axial positioning of the bobbin relative to the spring spider. In one embodiment, the radial thickness of the inner ring is not substantially larger than the radial thickness of the voice coil; thus, the inner ring does not materially contribute to the air gap length or to the mass of the moving assembly.

Figure 12:
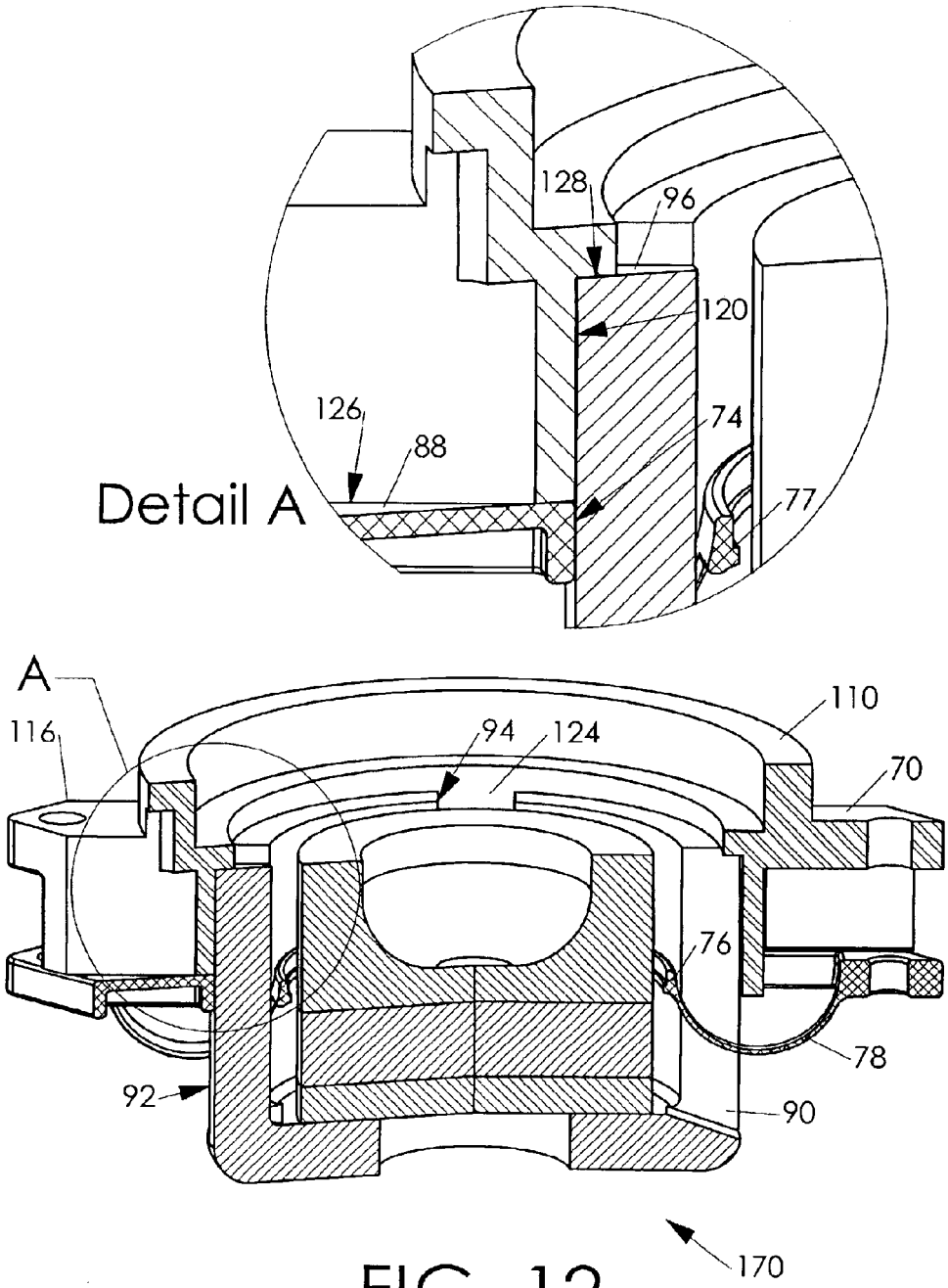
FIG. 12 shows a cutaway perspective view of the mounting ring and spring spider mounted to a motor structure.

FIG. 12 illustrates a subset 170 of the components of the speaker, to better demonstrate various coupling relationships and dimensions. The mating surface 128 of the mounting ring 110 is coupled to the top surface 96 of the cylindrical side walls of the yoke 90, to fix the mounting ring at a predetermined axial position. The inner surface 120 of the mounting ring is coupled to the outer cylindrical surface of the yoke, to fix the mounting ring at a predetermined radial position. Lugs 124 of the mounting ring are engaged with the slots 94 of the yoke, to fix the mounting ring at a predetermined radial angle.

Mating surface 88 of the spring spider 70 is coupled to the mating surface 126 of the mounting ring, to fix the spring spider at a predetermined axial position. The inner surface 74 of the spring spider is coupled to the outer cylindrical surface of the yoke, to fix the spring spider at a predetermined radial position. Lugs (122 not shown) of the mounting ring are engaged with slots (86 not shown) of the spring spider, to fix the spring spider at a predetermined radial angle; alternatively, the positions of the components' respective mounting holes can provide this alignment.

The combination of dimensions from the mating surface 128 to the mating surface 126, and from the mating surface 88 to the lip 77 determines the distance from the top of the yoke to the bottom of the bobbin. By appropriately placing the voice coil with respect to the bottom of the bobbin, the voice coil is centered (or placed in any other desired resting position) within the magnetic air gap. Thus, the spring spider/mounting ring assembly is effective in self-centering the voice coil assembly with respect to the motor structure, in both the axial and radial directions.

The yoke may be manufactured by any suitable process, such as stamping, cold forging, machining from billet, and so forth. In some embodiments, the entire yoke is one monolithic unit. In other embodiments, the yoke may include two or more pieces coupled together; for example, the cylindrical side wall may be one component and the base or floor may be another component which is magnetically coupled to the side wall component. In some embodiments, the spacer may be eliminated, such as if the floor of the yoke is stamped to have a recess into which the bobbin can extend, or to have a raised inner portion for elevating the magnet, as is commonly known in the art. The slots may be formed as part of the stamping or forging, or they may be cut in a separate step.

The mounting ring and the spring spider may be manufactured by any suitable process and from any suitable materials, which yield components exhibiting a high degree of unit-to-unit consistency.

The motor structure may be assembled into a motor assembly, and the rest of the components may separately assembled into a diaphragm assembly, then the motor assembly and the diaphragm assembly may be coupled together. The carefully dimensioned mounting ring and spring spider will provide a very high degree of unit-to-unit consistency having very good and consistent performance characteristics.

The spring spider offers another significant advantage in that it enables an extremely large amount of excursion, with dramatically improved low frequency response. For example, conventional midrange speakers typically have a maximum linear excursion: diaphragm diameter ratio in the neighborhood of 1/80. A speaker can readily be constructed according to the principles of this invention, in which the ratio is 1/8, for an order of magnitude improvement. Without the benefit of two suspension elements having high radial to axial stiffness ratios, positioned at or near the two extremes of the voice coil/diaphragm assembly, it is very difficult to keep the voice coil assembly properly aligned during large excursions, particularly in speakers in which the excursion is greater than 1/20 the diameter of the diaphragm. A conventional full-range 25 mm speaker might exhibit good linear performance down to 250 Hz, while a full-range 25 mm speaker according to this invention exhibits good linear performance down to 100 Hz or below.

Figure 13:
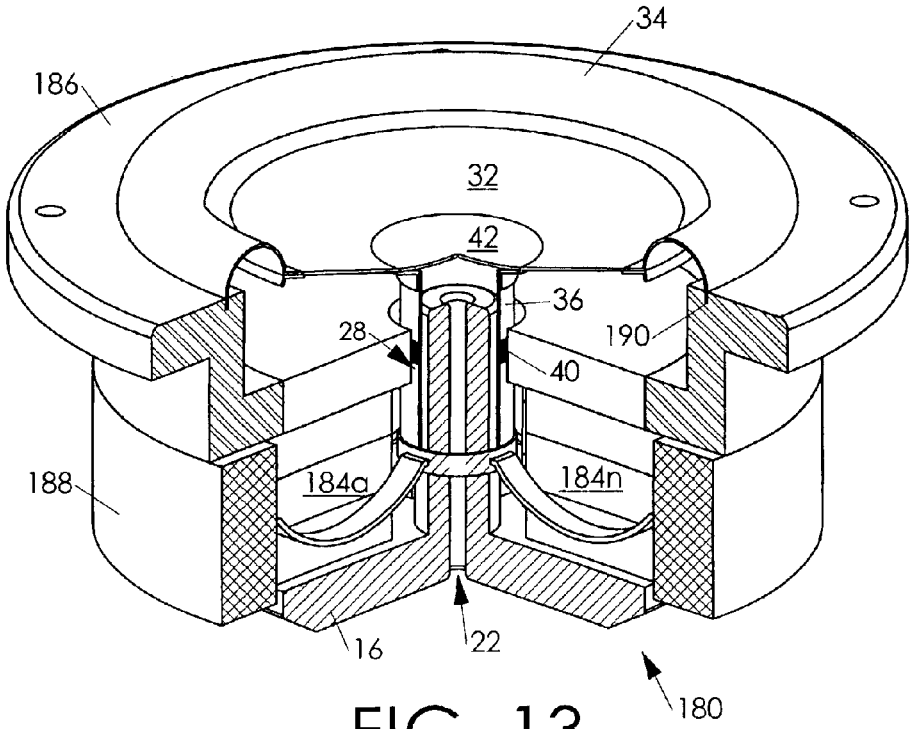
FIG. 13 shows one embodiment of an external magnet geometry speaker according to this invention.

FIG. 13 illustrates one embodiment of an external magnet geometry speaker 180 according to this invention, with a cutaway for improved visibility of various internal structures. The motor structure includes a T-yoke 16 having a vent 22. A plurality of magnets or magnet segments 184*a–n* are magnetically coupled between the T-yoke and a top plate 26. The top plate defines a magnetic air gap 28 with the T-yoke, and can be a conventional, monolithic top plate or it can be segmented like the magnets. A bobbin 36 and its voice coil 40 are disposed within the magnetic air gap, and coupled to a diaphragm 32 which has a dust cap 42.

A surround 34 couples the diaphragm to a mounting ring 186. In some embodiments, the mounting ring may be a conventional frame or basket. A spring spider 188 is coupled to the mounting ring and/or the magnets and/or the back plate of the T-yoke. The bobbin is suspended at its top end by the surround (mechanically operating through the diaphragm), and at its bottom end by the spring spider's inner ring. This provides the bobbin with a large moment arm between the suspension components, with the voice coil coupled to the bobbin somewhere in the middle, and will give the bobbin excellent resistance to rocking.

As shown, it is not necessarily the case that the surround mounts flat to the front surface of the mounting ring. In one embodiment, the surround may be coupled into a groove 190 formed or cut into the mounting ring. In other embodiments, the mounting ring is not necessarily a monolithic structure, and the surround could, for example, be sandwiched flat between two portions (not shown) of the mounting ring.

The reader should take note that, for clarity in illustration, two slightly different cutaways are used in FIG. 13—one through the spring spider, and another through the rest of the components, so the complete inner ring is shown encircling the cutaway pole piece.

Figure 14:
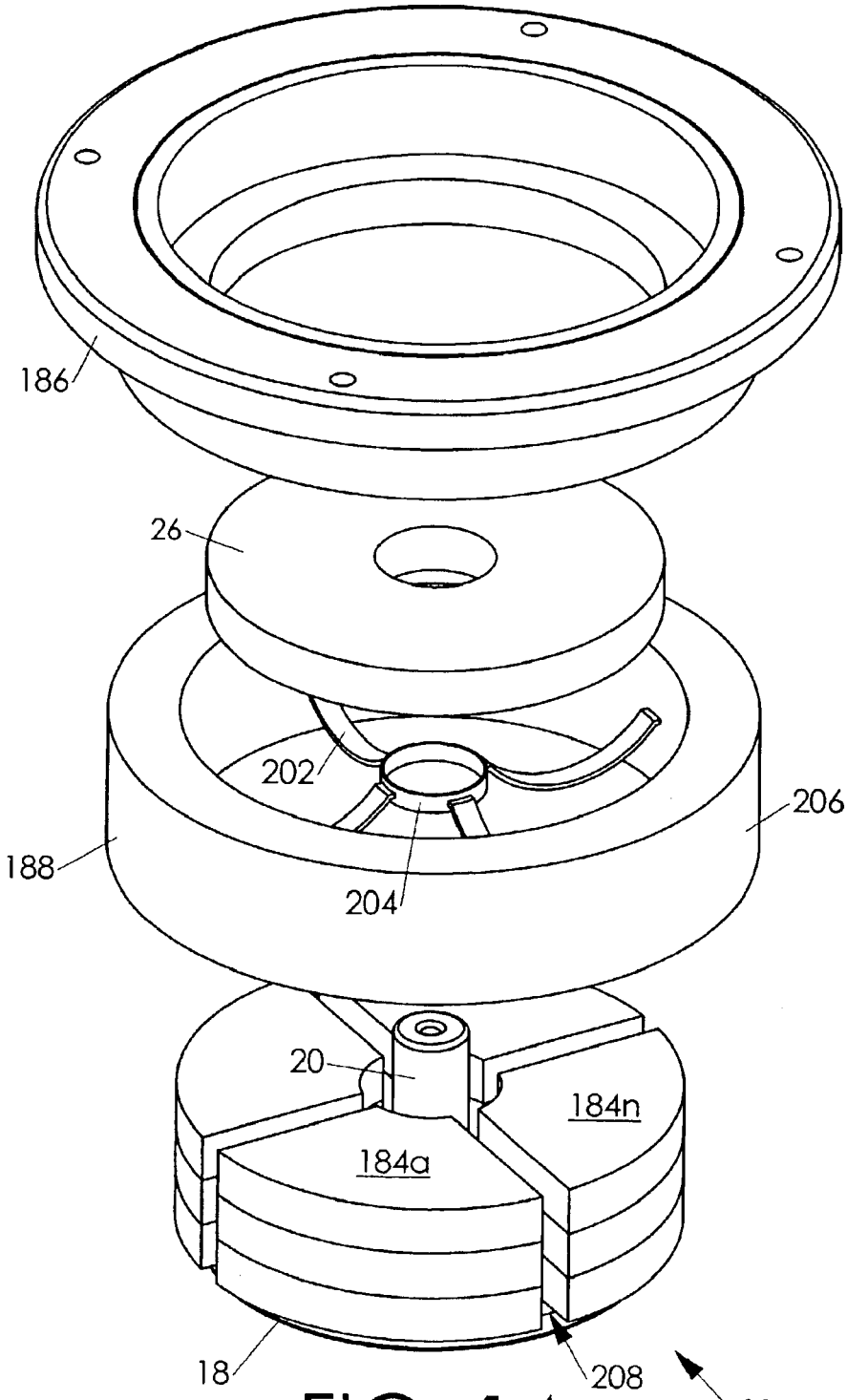
FIG. 14 shows a subset of the components of FIG. 13 in an exploded view.

FIG. 14 illustrates a subset 200 of the components of FIG. 13 in an exploded view, showing the mounting ring 186 separated from the spring spider 188. The spring spider includes a plurality of flexible spring members 202 coupling an inner ring 204 to an outer body 206. For ease of illustration, keying and positioning means are omitted from the spring spider and the mounting ring.

The motor structure of the speaker includes a T-yoke, whose back plate 18 and pole piece 20 are partially visible. In order to provide channels 208 through which the flexible spring members can pass, the magnet is segmented into a plurality of magnet segments 184*a–n*. Each magnet segment may include one or, as shown, a plurality of magnets in a stack. In some embodiments, the magnet segments may be pie-shaped as shown. In other embodiments, they may have other shapes, such as round, triangular, or any other suitable shape. It is desirable, but not strictly necessary, for the magnet segments 184*a* through 184*n* to have the same shape. In some embodiments, using magnet segments of different shapes may enable desirable mechanical results such as altering a particular external dimension of the motor structure to fit within a keep-out zone, for example, or even just pleasing aesthetics.

CONCLUSION

Mounting rings, frames, and baskets may collectively be termed means for supporting the suspension components. Although the internal magnet embodiments have been described with respect to mounting rings, the skilled reader will readily appreciate that any suitable and suitably sized means for supporting the suspension components may be used in conjunction with either internal or external magnet motor structures in practicing this invention.

The sizes of the various magnets, plates, and other components are shown in the FIGS. for ease of illustration only. In practice, the skilled designer will select components of various geometries according to the needs of the application at hand. The skilled reader will further appreciate that the drawings are for illustrative purposes only, and are not scale models of optimized transducers. The magnets, plates, and other components will need to be sized and positioned according to the needs of the application at hand, which is well within the abilities of an ordinary skilled electromagnetic transducer engineer who is armed with the teachings of this patent. Magnets can be sized, or their power selected, according to their diameter, their thickness, surface area, and/or the strength and density of their magnetic material.

"Ring-shaped" or "annular" should not necessarily be interpreted to mean "cylindrical", but can include other shapes, such as squares, which have holes through them and are thus substantially donut-shaped. "Disc-shaped" should not necessarily be interpreted to mean "cylindrical", but can include other shapes, such as squares, which do not have meaningful holes through them.

The skilled reader will readily appreciate that the various magnets illustrated in the drawings are shown with a particular N-S polarity orientation, and that the magnets can equally well be positioned with the opposite orientation.

If the voice coil is taller (along the axis) than the magnetic air gap, the motor is said to have an "overhung" voice coil. If, on the other hand, the voice coil were shorter than the magnetic air gap, the motor is said to have an "underhung" voice coil. If the voice coil and the magnetic air gap are of equal height, the motor is said to have a "zerohung" or "equalhung" voice coil.

Motors may generally be classified as having an external magnet geometry (in which a stack of ring plates and ring magnets surround a pole piece) or an internal magnet geometry (in which a cup contains a stack of magnets and a top plate). Pole plates and cups may collectively be termed yokes or magnetic return path members, as they serve as the return path for magnetic flux which has crossed over the magnetic air gap.

Materials may be classified as either magnetic materials or non-magnetic materials. Non-magnetic materials may also be termed non magnetically conductive materials; aluminum and chalk are examples of non-magnetic materials. Magnetic materials are classified as hard magnetic materials and soft magnetic materials. Hard magnetic materials are also called permanent magnets, and retain magnetic flux fields without outside causation. Soft magnetic materials are those which, although not permanent magnets, will themselves become magnetized and generate flux in response to their being placed in a magnetic field. Soft magnetic materials include the ferrous metals such as steel and iron.

Various embodiments have been described in terms of an internal magnet geometry, while others have been described in terms of an external magnet geometry. The skilled reader will appreciate that principles taught with reference to one geometry may often find applicability in the other geometry. An internal magnet geometry transducer is said to have a cup or yoke, while an external magnet geometry transducer is said to have a pole piece or T-yoke; cups and pole plates may generically be called magnetic return path members.

The various magnets, plates, poles, cups, and so forth may be termed magnetic motor components and, together, they may be termed a motor assembly.

While the invention has been described with reference to embodiments in which it is configured as an audio speaker, it is not limited to such configurations. In other embodiments, it may be configured as a microphone, or a position sensor, or an electromechanical actuator, or other such apparatus which may be characterized as an electromagnetic transducer.

The phrase "magnetically coupled to" is intended to mean "in magnetic communication with" or in other words "in a magnetic flux circuit with", and not "mechanically affixed to by means of magnetic attraction." The phrase "magnetic air gap" is intended to mean "gap over which magnetic flux is concentrated" and not limited to the case where such gap is actually filled with air; the gap could, in some applications, be filled with any suitable gas or liquid, or even be under vacuum. The skilled reader will appreciate that magnetic flux may be interpreted as flowing either from the north to the south, or from the south to the north.

When one component is said to be "adjacent" another component, it should not be interpreted to mean that there is absolutely nothing between the two components, only that they are in the order indicated.

The various features illustrated in the figures may be combined in many ways, and should not be interpreted as though limited to the specific embodiments in which they were explained and shown.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer comprising:

a slotted yoke including a side wall member and slots through the side wall member;

a mounting ring coupled to the slotted yoke; and a spring spider coupled to the mounting ring, the spring spider including, an inner ring disposed inside the yoke, an outer body disposed outside the yoke, and a plurality of flexible spring members coupled between the inner ring and the outer body and extending through the slots.

2. The electromagnetic transducer of claim 1 wherein:

the spring spider comprises a monolithic structure.

3. The electromagnetic transducer of claim 1 wherein:

one of the inner ring and the outer body comprise a distinct structure from the flexible spring members.

4. The electromagnetic transducer of claim 3 wherein:

the inner ring, the outer body, and the flexible spring members each comprises a distinct structure.

5. The electromagnetic transducer of claim 1 wherein:

the flexible spring members comprise plastic.

6. The electromagnetic transducer of claim 1 wherein:

the flexible spring members comprise metal.

7. The electromagnetic transducer of claim 1 wherein:

one of the spring spider and the mounting ring includes slots and the other includes first tabs, wherein the slots and the first tabs are sized and located to key the spring spider and the mounting ring into a fixed radial rotational position.

8. The electromagnetic transducer of claim 7 wherein:

one of the spring spider and the mounting ring includes second tabs sized and located to key the yoke into a fixed radial rotational position.

9. The electromagnetic transducer of claim 1 wherein:

the flexible spring members have a substantially arc shape.

10. The electromagnetic transducer of claim 9 wherein:

the substantially arc shape is concave toward an open end of the yoke.

11. The electromagnetic transducer of claim 1 wherein:

the outer body includes cutaways extending outward from the yoke, and the flexible spring members join the outer body at outer positions of the cutaways.

12. The electromagnetic transducer of claim 1 wherein:

the mounting ring includes support blocks each having a mating surface for engaging the outer body of the spring spider.

13. The electromagnetic transducer of claim 1 wherein:

the mounting ring includes, an inner cylindrical surface dimensioned to engage an external cylindrical surface of the yoke to provide radial alignment of the mounting ring to the yoke, and a mating surface to engage an end surface of the yoke to provide axial alignment of the mounting ring to the yoke.

14. The electromagnetic transducer of claim 1 wherein:

the mounting ring further includes, at least one tab dimensioned to engage a corresponding at least one slot of the yoke to provide rotational alignment of the mounting ring to the yoke.

15. The electromagnetic transducer of claim 1 further comprising:

a magnet magnetically coupled to the yoke;

a top plate magnetically coupled to the magnet and defining a magnetic air gap between the top plate and the yoke;

a bobbin coupled to the inner ring;

a voice coil coupled to the bobbin and disposed within the magnetic air gap;

a diaphragm coupled to the bobbin; and a flexible suspension member coupled to the mounting ring and to one of the diaphragm and the bobbin.

16. The electromagnetic transducer of claim 15 further comprising:

flexible leads coupled to the voice coil and extending out through one or more of the slots of the yoke to provide electrical connection to the voice coil.

17. The electromagnetic transducer of claim 15 further comprising:

an electrically conductive member coupled to the top plate to reduce flux modulation during operation of the electromagnetic transducer.

18. The electromagnetic transducer of claim 15 wherein:

an outer diameter of the inner ring is not significantly larger than an outer diameter of the voice coil.

19. The electromagnetic transducer of claim 1 configured as an audio speaker.

20. The electromagnetic transducer of claim 1 configured as a linear actuator.

21. An audio speaker comprising:

an internal magnet motor structure including a slotted yoke and a magnetic air gap;

a diaphragm assembly including a diaphragm, a bobbin, and a voice coil;

a mounting ring coupled to the slotted yoke;

a flexible surround coupled to the diaphragm assembly and to the mounting ring; and a spring spider coupled to the bobbin inside the slotted yoke and to the mounting ring outside the slotted yoke, the spring spider including a plurality of flexible spring members extending through respective slots of the slotted yoke.

22. The audio speaker of claim 21 wherein the spring spider further includes:

an inner ring disposed within the slotted yoke and coupling the bobbin to the flexible spring members.

23. The audio speaker of claim 21 wherein:

a position of the voice coil within the magnetic air gap is determined by, an axial distance from where the mounting ring couples to the slotted yoke to where the mounting ring couples to the spring spider, an axial distance from where the spring spider couples to the mounting ring to where the spring spider couples to the bobbin, and an axial distance from where the spring spider couples to the bobbin to where the voice coil is coupled to the bobbin.

24. The audio speaker of claim 21 further comprising:

means for rotationally positioning the spring spider with respect to the slotted yoke, to position the flexible spring members within slots of the slotted yoke.

25. The audio speaker of claim 21 wherein:

one of the mounting ring and the spring spider includes means for axially positioning the mounting ring and the spring spider with respect to the slotted yoke.

26. The audio speaker of claim 21 having a ratio of maximum linear excursion: diaphragm diameter less than 1:20.

27. An audio speaker comprising:

a motor structure including, a yoke, a permanent magnet magnetically coupled to the yoke, and a top plate magnetically coupled to the permanent magnet and defining a magnetic air gap with the yoke, wherein at least one of the yoke and the permanent magnet includes substantially radial slots;

a diaphragm assembly including, a diaphragm, a bobbin coupled to the diaphragm, a voice coil coupled to the bobbin and disposed within the magnetic air gap;

means for supporting suspension components;

an upper suspension component coupled to the means for supporting and to the diaphragm; and a lower suspension component including, an inner ring coupled to the bobbin, an outer body coupled to at least one of the motor structure and the means for supporting, and a plurality of flexible spring members coupled to the inner ring and to the outer body and disposed in respective ones of the slots.

28. The audio speaker of claim 27 wherein the yoke includes the slots.

29. The audio speaker of claim 27 wherein the permanent magnet includes the slots.

30. The audio speaker of claim 27 wherein the outer body is coupled to the means for supporting.

31. The audio speaker of claim 27 wherein the means for supporting comprises a mounting ring.

32. The audio speaker of claim 27 wherein the inner ring, the outer body, and the flexible spring members comprise a monolithic structure.

33. The audio speaker of claim 27 further comprising:

flexible, electrically conductive leads coupled to the voice coil and extending out through respective ones of the slots.

* * * * *